US011628668B2

(12) United States Patent
Yoda

(10) Patent No.: US 11,628,668 B2
(45) Date of Patent: Apr. 18, 2023

(54) DROPLET DISCHARGING DEVICE

(71) Applicant: Seiko Epson Corporation, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/498,826

(22) Filed: Oct. 12, 2021

(65) Prior Publication Data

US 2022/0118762 A1 Apr. 21, 2022

(30) Foreign Application Priority Data

Oct. 15, 2020 (JP) ..... JP2020-174004

(51) Int. Cl.
*B41J 2/14* (2006.01)
*B41J 2/045* (2006.01)
*B41J 11/00* (2006.01)

(52) U.S. Cl.
CPC ..... *B41J 2/14088* (2013.01); *B41J 2/04553* (2013.01); *B41J 2/04566* (2013.01); *B41J 11/0024* (2021.01); *B41J 11/00242* (2021.01)

(58) Field of Classification Search
CPC ..... B41J 11/0024; B41J 2/01; B41J 2/04553; B41J 2/04566; B41J 11/00244; B41J 11/00242; B41J 2/14088; B41J 2/04563; B41J 2/1408; B41J 29/377; B41J 2202/08
See application file for complete search history.

(56) References Cited

U.S. PATENT DOCUMENTS

2015/0174924 A1* 6/2015 Fuchioka ..... B41J 11/00222 347/102
2019/0275813 A1 9/2019 Yoda

FOREIGN PATENT DOCUMENTS

JP 2019-155653 9/2019

* cited by examiner

*Primary Examiner* — Kristal Feggins
(74) *Attorney, Agent, or Firm* — Workman Nydegger

(57) ABSTRACT

A droplet discharging device includes a head including a nozzle configured to discharge a droplet onto a medium, a heater configured to heat, the medium onto which the droplet is discharged from the head, at a position opposing to the head, an air blowing fan configured to blow outside air from an outside toward an inside of a housing that accommodates the head and the heater, a temperature sensor configured to detect a temperature of the outside air blown by the air blowing fan, and a control unit, and when the temperature of the outside air detected by the temperature sensor is lower than a preset temperature, the control unit changes a set temperature of the heater to a temperature lower than a predetermined temperature.

6 Claims, 5 Drawing Sheets

| | WHEN FIRST HEATER IS NOT DRIVEN | | | | | | | WHEN FIRST HEATER IS DRIVEN | | | | | |
|---|---|---|---|---|---|---|---|---|---|---|---|---|---|
| LINE NUMBER | TEMPERTURE OF OUTSIDE AIR T1 [°C] | RELATIVE HUMIDITY OF OUTSIDE AIR RH1 [%] | SATURATED WATER VAPOR PRESSURE eT1 [hPa] | SATURATED WATER VAPOR AMOUNT aT1 [g/m$^3$] | ABSOLUTE HUMIDITY aRH1 [g/m$^3$] | WATER VAPOR PRESSURE FROM RE ATIVE HUMIDITY eRH1 [hPa] | WATER VAPOR PRESSURE DIFFERENCE ed1 [hpa] | SETTING TEMPERATURE OF HEATER T2 [°C] | SATURATED WATER VAPOR PRESSURE et2 [hPa] | SATURATED WATER VAPOR AMOUNT aT2 [g/m$^3$] | RELATIVE HUMIDITY RH2 [%] | WATER VAPOR PRESSURE FROM RE ATIVE HUMIDITY eRH2 [hPa] | WATER VAPOR PRESSURE DIFFERENCE ed2 [hpa] |
| 1 | 27 | 65 | 35.7 | 25.8 | 16.8 | 23.2 | 12.5 | 40 | 73.8 | 51.1 | 31.4 | 23.2 | 50.6 |
| 2 | 18 | 65 | 20.6 | 15.4 | 10.0 | 13.4 | 7.2 | 40 | 73.8 | 51.1 | 18.2 | 13.4 | 60.4 |
| 3 | 35 | 65 | 56.2 | 39.6 | 25.7 | 36.6 | 19.7 | 40 | 73.8 | 51.1 | 49.6 | 36.6 | 37.2 |
| 4 | 27 | 40 | 35.7 | 25.8 | 10.3 | 14.3 | 21.4 | 40 | 73.8 | 51.1 | 19.3 | 14.3 | 59.5 |
| 5 | 27 | 90 | 35.7 | 25.8 | 23.2 | 32.1 | 3.6 | 40 | 73.8 | 51.1 | 43.5 | 32.1 | 41.7 |
| 6 | 18 | 65 | 20.6 | 15.4 | 10.0 | 13.4 | 7.2 | 37.3 | 63.8 | 44.6 | 21.0 | 13.4 | 50.4 |
| 7 | 18 | 40 | 20.6 | 15.4 | 6.2 | 8.3 | 12.4 | 35.8 | 58.8 | 41.3 | 14.1 | 8.3 | 50.5 |
| 8 | 35 | 65 | 56.2 | 39.6 | 25.7 | 36.6 | 19.7 | 43.2 | 87.3 | 59.9 | 41.9 | 36.6 | 50.8 |
| 9 | 35 | 90 | 56.2 | 39.6 | 35.6 | 50.6 | 5.6 | 46.1 | 101.4 | 68.9 | 49.9 | 50.6 | 50.8 |
| 10 | 27 | 40 | 35.7 | 25.8 | 10.3 | 14.3 | 21.4 | 37.6 | 64.8 | 45.3 | 22.0 | 14.3 | 50.6 |
| 11 | 27 | 90 | 35.7 | 25.8 | 23.2 | 32.1 | 3.6 | 42.2 | 82.9 | 57.0 | 38.7 | 32.1 | 50.8 |

FIG. 5

DROPLET DISCHARGING DEVICE

The present application is based on, and claims priority from JP Application Serial Number 2020-174004, filed Oct. 15, 2020, the disclosure of which is hereby incorporated by reference herein in its entirety.

BACKGROUND

1. Technical Field

The present disclosure relates to a droplet discharging device.

2. Related Art

Typically, a droplet discharging device provided with a heater for drying a medium onto which liquid is discharged has been known. JP-A-2019-155653 discloses a heating device that is arranged downstream of a printing unit and suppresses media damage such as deformation and damage that occurs when the medium is dried.

For example, there is a droplet discharging device that immediately dries ink that has landed on the medium in the printing unit in order to suppress coagulation of the ink. However, it is difficult to apply the heating device disclosed in JP-A-2019-155653 to such a droplet discharging device, and thus a droplet discharging device that suppresses media damage during drying of the medium in the printing unit has been desired.

SUMMARY

A droplet discharging device includes a head including a nozzle configured to discharge a droplet onto a medium, a heater configured to heat, the medium onto which the droplet is discharged from the head, at a position opposing to the head, an air blowing fan configured to blow outside air from an outside toward an inside of a housing that accommodates the head and the heater, a temperature sensor configured to detect a temperature of the outside air blown by the air blowing fan, and a control unit, and when the temperature of the outside air detected by the temperature sensor is lower than a preset temperature, the control unit changes a set temperature of the heater to a temperature lower than a predetermined temperature.

A droplet discharging device includes a head including a nozzle configured to discharge a droplet onto a medium, a heater configured to heat, the medium onto which the droplet is discharged from the head, at a position opposing to the head, an air blowing fan configured to blow outside air from an outside toward an inside of a housing that accommodates the head and the heater, a humidity sensor configured to detect a humidity of the outside air blown by the air blowing fan, and a control unit, and when the humidity of the outside air detected by the humidity sensor is lower than a preset humidity, the control unit changes a set temperature of the heater to a temperature lower than a predetermined temperature.

BRIEF DESCRIPTION OF THE DRAWINGS

FIG. 5 is a table showing a relationship between the temperature and the relative humidity of outside air, the set temperature of a heater, and the water vapor pressure difference.

DESCRIPTION OF EXEMPLARY EMBODIMENTS

1. Embodiment 1-1. Device Configuration

Figure 1:
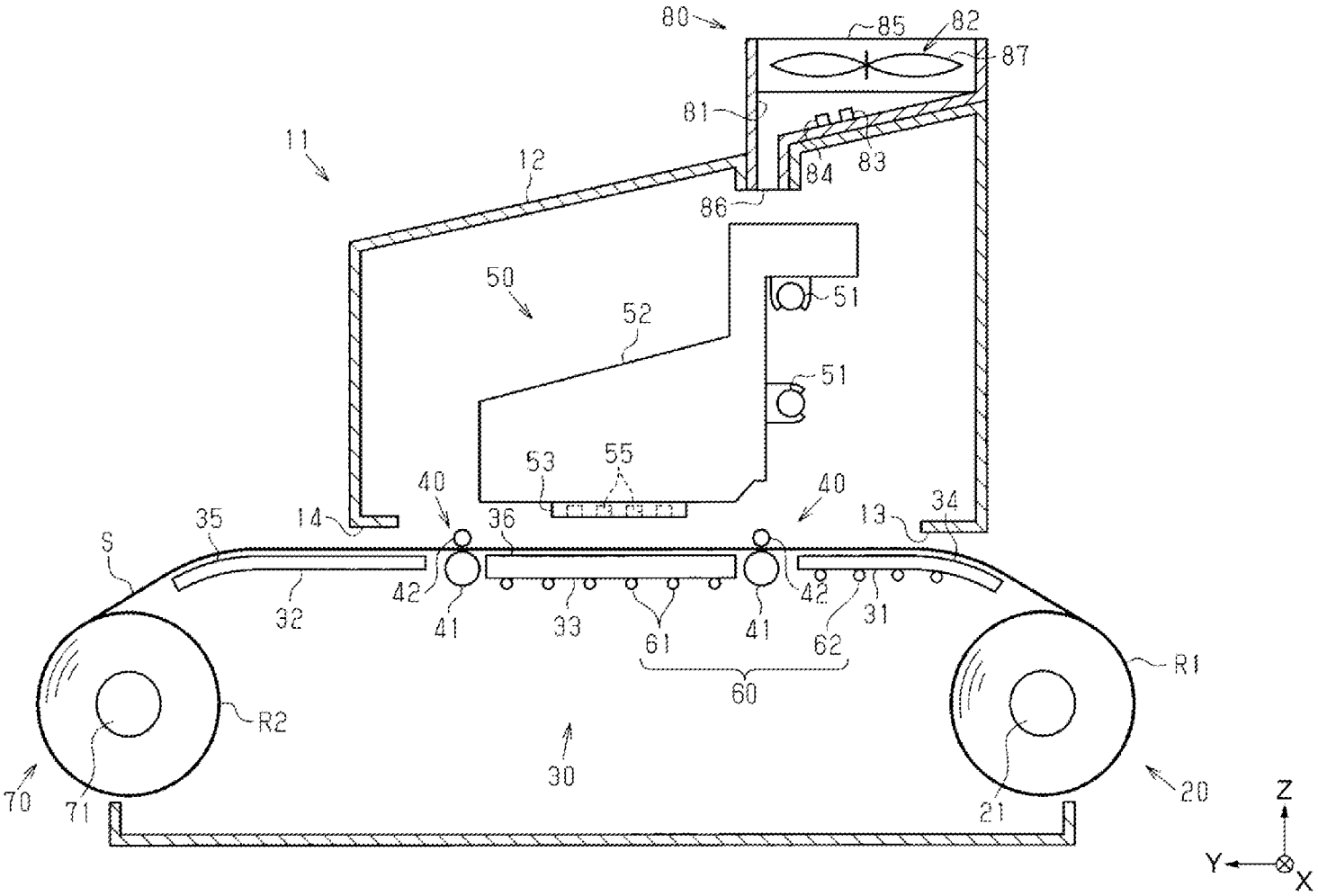
FIG. 1 is a side view schematically illustrating a droplet discharging device according to an embodiment.

A schematic configuration of a droplet discharging device 11 according to an embodiment will be described. In the coordinates illustrated in the drawings, three imaginary axes orthogonal to each other are designated as an X-axis, a Y-axis, and a Z-axis, while assuming that the droplet discharging device 11 is placed on the horizontal plane. The X-axis is the imaginary axis parallel to a width direction of a medium S. The Y-axis is the imaginary axis parallel to a transport direction. The Z-axis is the imaginary axis parallel to the vertical direction.

First, an embodiment of the droplet discharging device will be described below with reference to the accompanying drawings.

As illustrated in FIG. 1, the droplet discharging device 11 includes a housing 12. The droplet discharging device 11 includes a feeding unit 20 configured to feed out the medium S, and a medium support unit 30 configured to support the medium S fed from the feeding unit 20. The droplet discharging device 11 includes a transport unit 40 configured to transport the medium S in the transport direction along the medium support unit 30. The droplet discharging device 11 includes a printing unit 50 configured to print an image, such as a character and a photograph on the medium S, and a heating unit 60 configured to heat the medium S printed by the printing unit 50. The droplet discharging device 11 includes a winding unit 70 configured to wind the medium S printed by the printing unit 50, and a ventilation unit 80 configured to ventilate the inside of the housing 12.

The feeding unit 20 is arranged such that a portion thereof is exposed to the outside of the housing 12. The feeding unit 20 includes a feeding shaft 21 configured to detachably hold a roll body R in which the medium S is wound. The feeding unit 20 unwinds the medium S from the roll body R1 and feeds the medium S by rotating the feeding shaft 21 that holds the roll body R1. The feeding unit 20 according to the present embodiment feeds the medium S by rotating the feeding shaft 21 in the counterclockwise direction. In the present embodiment, the medium S is a paper.

The medium support unit 30 includes a first guide unit 31, a second guide unit 32, and a support unit 33 each constituted by a plate-shaped member. The first guide unit 31 is arranged such that a portion thereof is exposed to the outside of the housing 12. The first guide unit 31 supports the medium S so as to guide the medium S fed from the feeding unit 20 toward the inside of the housing 12 through a supplying port 13 which is an opening of the housing 12. The support unit 33 is arranged inside the housing 12 and supports the medium S guided by the first guide unit 31. The second guide unit 32 is arranged such that a portion thereof is exposed to the outside of the housing 12, and supports the medium S so as to guide the medium S passing on the support unit 33 through a discharge port 14 which is an opening of the housing 12, toward the outside of the housing 12. In other words, the first guide unit 31 is arranged upstream of the support unit 33 in the transport direction. The second guide unit 32 is arranged downstream of the support unit 33 in the transport direction.

Upper surfaces of the first guide unit 31 and second guide unit 32 are guide surfaces 34 and 35 for guiding the medium S. An upper surface of the support unit 33 is a support surface 36 for guiding the medium S. In the present embodiment, the transport direction in which the medium S is transported refers to a direction in which the medium S moves on the support surface 36 of the support unit 33. In the present embodiment, the support unit 33 is configured such that the support surface 36 extends horizontally. The first guide unit 31 and the second guide unit 32 are configured such that a portion of the guide surfaces 34 and 35 is curved with respect to the support surface 36.

The transport unit 40 is arranged inside the housing 12. The transport unit 40 according to the present embodiment is arranged at two locations between the first guide unit 31 and the support unit 33 and between the support unit 33 and the second guide unit 32, in the transport direction. The transport unit 40 includes a driving roller 41 configured to drive and rotate, and a driven roller 42 configured to be driven and rotated by the rotation of the driving roller 41. The transport unit 40 transports the medium S along the medium support unit 30 by rotating the driving roller 41 and the driven roller 42 with the medium S sandwiched therebetween. In the present embodiment, the driving roller 41 is configured to contact the medium S from below in the vertical direction. The driven roller 42 is configured to contact the medium S from above in the vertical direction.

The printing unit 50 is provided inside the housing 12 and is arranged so as to oppose to the support unit 33. The printing unit 50 includes a guide shaft 51 that extends in the width direction of the medium S that is transported, a carriage 52 supported by the guide shaft 51, and a head 53 mounted on the carriage 52. The carriage 52 is movable along the guide shaft 51. That is, the carriage 52 is configured to move in the width direction. Note that in the present embodiment, two guide shafts 51 are provided.

The head 53 is mounted on the carriage 52 so as to be exposed from a lower surface of the carriage 52. The head 53 includes a plurality of nozzles 55 configured to discharge, for example, ink which is an example of liquid, as a droplet on the lower surface thereof opposing to the support unit 33. The head 53 prints an image on the medium S by discharging droplets from the nozzle 55 toward the medium S supported by the support unit 33. In the present embodiment, the ink discharged by the head 53 is an aqueous resin. Water is used as a solvent for the aqueous resin.

The heating unit 60 includes a first heater 61 and a second heater 62 as a heater, and is arranged inside the housing 12. A plurality of the first heaters 61 are arranged at intervals in the transport direction so as to extend along the lower surface of the support unit 33. A plurality of the second heaters 62 are arranged at intervals in the transport direction so as to extend along the lower surface of the first guide unit 31. The first heater 61 and the second heater 62 are configured by, for example, tube heaters arranged so as to extend in the width direction, and generate heat by being energized. By heating the support unit 33 at a position opposing to the head 53 from the lower surface thereof, the first heater 61 indirectly heats the medium S located on the support surface 36, which is the upper surface of the support unit 33. In other words, the first heater 61 heats the medium S onto which droplets are discharged by the head 53 by heating the support unit 33. The first heater 61 promotes fixing of the image printed on the medium S by evaporating the water content of the droplets discharged from the head 53 onto the medium S. The first heater 61 according to the present embodiment is configured to generate heat at a set temperature. The second heater 62 preheats the medium S before the droplets are discharged thereonto from the head 53, according to the set temperature of the first heater 61.

The winding unit 70 is arranged such that a portion thereof is exposed to the outside of the housing 12. The winding unit 70 includes a feeding shaft 71 configured to detachably hold a roll body R2 in which the medium S is wound. The winding shaft 71 winds the medium S, on which the head 53 discharges the droplets and the image is printed, thereby forming the roll body R2. The winding unit 70 according to the present embodiment winds the medium S by rotating the winding shaft 71 in the counterclockwise direction.

A ventilation unit 80 is arranged at an upper portion of the housing 12, and a portion of the ventilation unit 80 is provided so as to be exposed to the outside of the housing 12. The ventilation unit 80 includes an intake flow path 81 for taking in outside air from the outside of the housing 12 toward the inside of the housing 12, and an air blowing fan 82 for blowing the outside air into the housing 12 through the intake flow path 81. The ventilation unit 80 includes a temperature sensor 83 configured to detect the temperature of the outside air taken in by the air blowing fan 82, and a humidity sensor 84 configured to detect the humidity of the outside air taken in by the air blowing fan 82. The intake flow path 81 is provided so as to penetrate the inside and outside of the housing 12, and has an intake port 85 that opens to the outside of the housing 12, and an outlet 86 that opens to the inside of the housing 12. The intake port 85 is open larger as compared with the outlet 86. The outlet 86 is wide open so as to extend in the width direction.

The air blowing fan 82 is arranged in the intake flow path 81 at a position closer to the intake port 85. The air blowing fan 82 according to the present embodiment is, for example, configured as an axial fan, and blows the outside air by rotating blades 87 thereof. The temperature sensor 83 and the humidity sensor 84 are arranged in the intake flow path 81 at positions closer to the outlet 86 than the air blowing fan 82. That is, the temperature sensor 83 and the humidity sensor 84 detect the temperature and humidity of the outside air flowing through the intake flow path 81 by the driving of the air blowing fan 82.

By driving the air blowing fan 82, the ventilation unit 80 blows the outside air taken in through the intake flow path 81 toward a region where the carriage 52 reciprocates in the housing 12. The atmosphere inside the housing 12 is discharged to the outside of the housing 12 from the supplying port 13 and the discharge port 14 by the outside air taken in through the intake flow path 81. At this time, mist of ink discharged from the head 53, and a floating matter suspended in the housing 12, such as paper powder generated from the medium S, are discharged to the outside of the housing 12 together with the atmosphere inside the housing 12. In the present embodiment, the wind speed of the outside air blown out from the outlet 86 by the air blowing fan 82 is 1.0 m/s.

Figure 2:
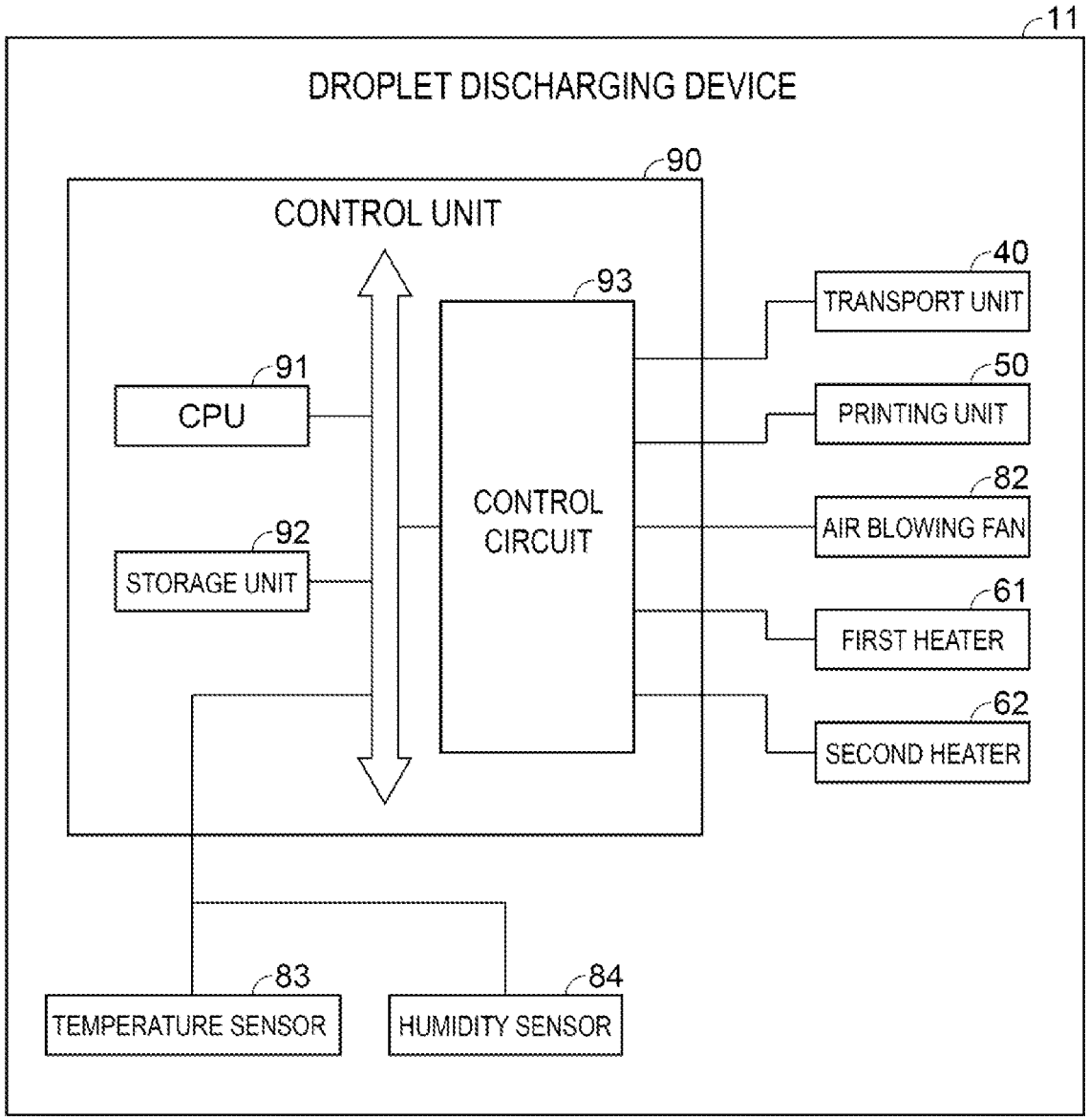
FIG. 2 is a block diagram illustrating an electrical configuration of the droplet discharging device.

Next, an electrical configuration of the droplet discharging device 11 will be described with reference to FIG. 2.

The droplet discharging device 11 includes the control unit 90 configured to control the units included in the droplet discharging device 11. The control unit 90 is configured to include a CPU (Central Processing Unit) 91, a storage unit 92, a control circuit 93, and the like. The CPU 91 is connected to the storage unit 92 and the control circuit 93 through a bus.

The CPU 91 is an arithmetic processing device that generates various input signal processes, print data for performing printing from received image data, and the like. The CPU 91 controls the entire droplet discharging device 11 based on the program and print data stored in the storage unit 92.

The storage unit 92, which serves as a storage medium that ensures an area for storing the programs, a work area, and the like of the CPU 91, includes a storage device such as a Random Access Memory (RAM), an Electrically Erasable Programmable Read Only Memory (EEPROM), or the like. The storage unit 92 stores general image processing application software for handling image data and printer driver software for generating print data to make the droplet discharging device 11 perform printing. Further, the storage unit 92 stores a heater setting temperature table, which will be described later.

The droplet discharging device 11 includes the control unit 90 configured to comprehensively control the device. The control unit 90 is electrically connected to each of the temperature sensor 83 and the humidity sensor 84. The control unit 90 is configured to receive signals transmitted from the temperature sensor 83 and the humidity sensor 84. The temperature sensor 83 is configured to transmit a signal based on the detected temperature of the outside air toward the control unit 90. The humidity sensor 84 is configured to transmit a signal based on the detected humidity of the outside air toward the control unit 90.

The control unit 90 is electrically connected to the transport unit 40, the printing unit 50, the first heater 61, the second heater 62, and the air blowing fan 82. The control circuit 93 is configured to generate and transmit signals for controlling the drive of the transport unit 40, the printing unit 50, the first heater 61, the second heater 62, and the air blowing fan 82. The droplet discharging device 11 according to the present embodiment is configured to communicate with an external terminal such as a personal computer, for example. In other words, the control unit 90 is configured to receive information such as image data input from the external terminal.

1-2. Water Evaporation Mechanism

Next, the evaporation mechanism of the water contained in the droplets discharged onto the medium S will be described with reference to FIGS. 3 to 5.

Figure 3:
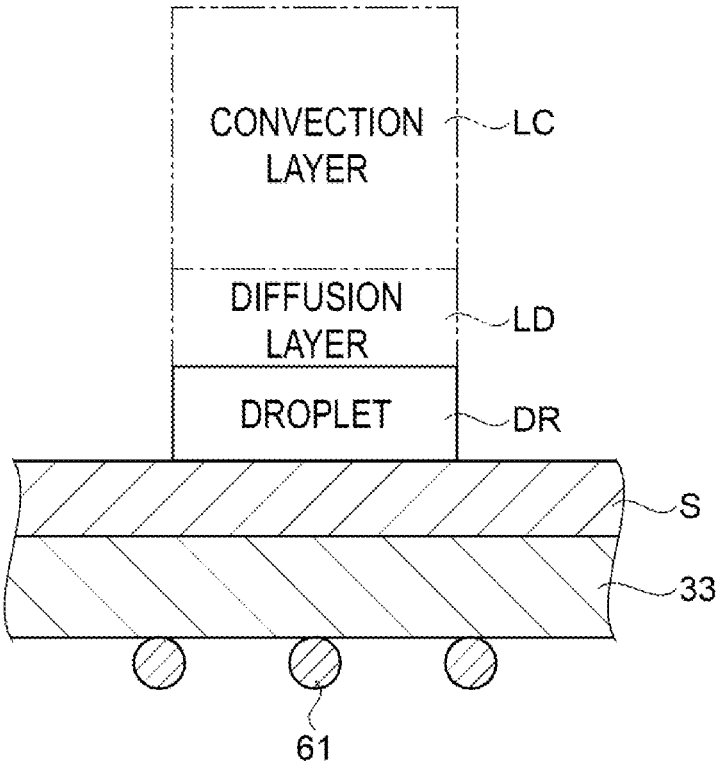
FIG. 3 is a diagram illustrating a water evaporation mechanism.

As illustrated in FIG. 3, the surface of a droplet DR that has landed on the medium S is in a state of the saturated water vapor having humidity of 100%. A convection layer LC is a surrounding environment on the medium S on which the droplet DR lands, that is, on the support unit 33 on which the first heater 61 is provided. A diffusion layer LD is a layer in which saturated water vapor on the upper surface of the droplet DR diffuses into an atmosphere of the relative humidity of the surrounding environment. A water molecule, which is water contained in the droplet DR, moves in the diffusion layer LD, and becomes water vapor and evaporates into the convection layer LC. The thickness of the diffusion layer LD varies depending on the airflow and is approximately from 1 mm to 10 mm. The thickness of the diffusion layer LD affects an evaporation rate of water, but since the airflow in the housing 12 flows at a constant rate due to the blowing of the air blowing fan 82, the influence thereof can be ignored in the present embodiment.

In order for the water contained in the droplet DR to evaporate and become water vapor to move to the convection layer LC, a difference in water vapor pressure between the water vapor pressure on the surface of the droplet DR and the water vapor pressure in the convection layer LC is required. In other words, the evaporation rate of water depends on this water vapor pressure difference.

As shown in the first line of FIG. 5, when the first heater 61 is not driven, the surrounding environment on the support unit 33 is the same as a temperature of the outside air T1=27° C. detected by the temperature sensor 83 and a relative humidity of the outside air RH1=65% detected by the humidity sensor 84. A water vapor pressure difference ed1 in this case will be described.

Since the water content on the surface of the droplet DR is saturated, the water vapor pressure thereof becomes a saturated water vapor pressure eT1. The saturated water vapor pressure eT1 can be obtained by substituting the temperature T1 into an Equation (1).

[Mathematical Equation 1]

$$eT1 = 6.1078 \times 10^{\left(\frac{7.5 \times T1}{T1 \times 237.3}\right)} \quad (1)$$

From the Equation (1), when the temperature T1=27° C., the saturated water vapor pressure eT1 is 35.7 hPa. The water vapor pressure of the convection layer LC, that is, a water vapor pressure eRH1 from the relative humidity RH1, is proportional to the relative humidity RH1 and is obtained by the product of the saturated water vapor pressure eT1 and the relative humidity RH1. When the relative humidity RH1=65%, the water vapor pressure eRH1 is 23.2 hPa. From this, the water vapor pressure difference ed1 when the first heater 61 is not driven is 12.5 hPa, from the difference between the saturated water vapor pressure eT1 and the water vapor pressure eRH1 of the convection layer LC. When the first heater 61 is not driven, the water vapor pressure difference ed1 becomes a driving force that causes the water content contained in the droplet DR landed on the medium S to diffuse into the convection layer LC. The water vapor pressure difference ed1 when the first heater 61 is not driven is obtained by the following equation.

[Mathematical Equation 2]

$$ed1 = eT1 - eT1 \times RH1/100 \quad (2)$$

1-3. Humidity Change Inside the Housing 12

Next, as shown in the first line of FIG. 5, a case in which the surrounding environment on the support unit 33 having the temperature of T1=27° C. and the relative humidity of RH1=65% increases to a temperature of T2=40° C. by the drive of the first heater 61 will be described.

Figure 4:
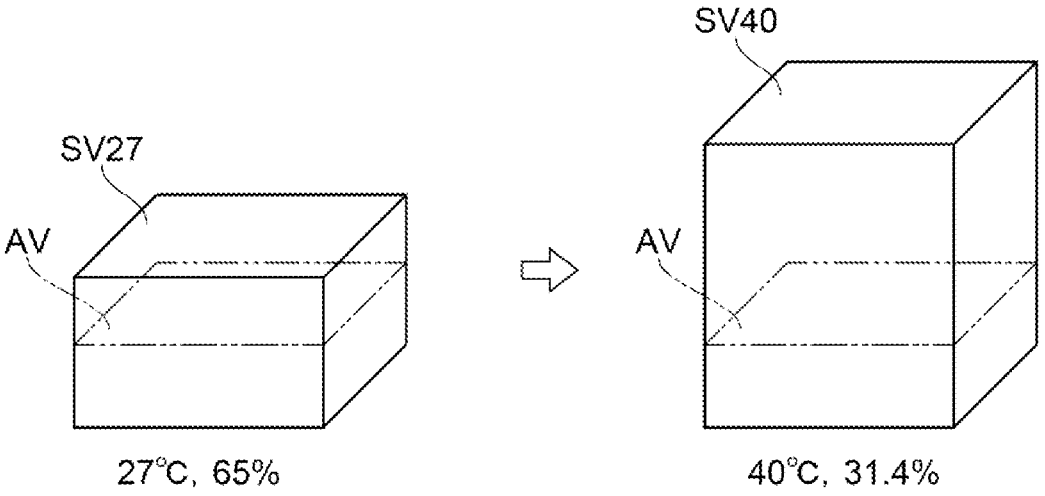
FIG. 4 is a diagram illustrating humidity change inside a housing.

A cubic SV27 of the solid line illustrated in FIG. 4 represents a saturated water vapor amount aril when the temperature T1=27° C. A cubic AV of the dashed line represents the amount of water vapor that is actually present. The amount of water vapor that is actually present is referred to as an absolute humidity aRH1. The saturated water vapor amount aril can be obtained by substituting the saturated water vapor pressure eT1 into the following equation.

[Mathematical Equation 3]

$$aT1 = 217 \times \frac{eT1}{T1 + 237.3} \quad (3)$$

From the Equation (3), when the temperature T1=27° C., the saturated water vapor amount aril is 25.8 g/m3. The absolute humidity aRH1 can be obtained by the product of the saturated water vapor amount aril and the relative humidity RH1. When the relative humidity RH1 is 65%, the absolute humidity aRH1 is 16.8 g/m$^3$.

When the first heater 61 is driven, the temperature on the support unit 33 increases to the set temperature of the first heater 61 of T2=40° C.

A cubic SV40 of the solid line illustrated in FIG. 4 represents a saturated water vapor amount aT2 when the temperature T2=40° C. The saturated water vapor pressure eT2, when the first heater 61 is driven and the temperature on the support unit 33 increases from T1=27° C. to the set temperature T2=40° C. of the first heater 61, can be obtained from the temperature T2 in the same manner as in the Equation (1). When the temperature T2=40° C., the saturated water vapor pressure eT2 is 73.8 hPa. The saturated water vapor amount aT2 can be obtained from the saturated water vapor pressure eT2 and the temperature T2 in the same manner as in the Equation (3). When the temperature T2=40° C., the saturated water vapor amount aT2 increases to 51.1 g/m$^3$.

However, the amount of water vapor that was present when the temperature T1=27° C., that is, the absolute humidity aRH1, does not change even when the temperature increases to T2=40° C., so that the relative humidity RH2 decreases. The relative humidity RH2 can be obtained by dividing the absolute humidity aRH1 by the saturated water vapor amount aT2. When the temperature increases from T1=27° C. to T2=40° C., the relative humidity decreases from RH1=65% to RH2=31.4%. That is, the surrounding environment on the support unit 33 changes from, the temperature T1=27° C. and the relative humidity RH1=65% when the first heater 61 is not driven, to the set temperature T2=40° C. of the first heater 61 and the relative humidity RH2=31.4%.

The water vapor pressure eRH2 from the relative humidity RH2 when the first heater 61 is driven can be obtained by the product of the saturated water vapor pressure eT2 and the relative humidity RH2. When the relative humidity RH2=31.4%, the water vapor pressure eRH2 is 23.2 hPa. From this, the water vapor pressure difference ed2 when the first heater 61 is driven is 50.6 hPa, from the difference between the saturated water vapor pressure eT2 and the water vapor pressure eRH2 of the convection layer LC. As the water vapor pressure difference ed1=12.5 hPa increases to the water vapor pressure difference ed2=50.6 hPa, the evaporation rate of water also increases.

As described above, when the first heater 61 is driven, the relative humidity changes from RH1=65% to RH2=31.4%, but the absolute humidity aRH1 which is the amount of water vapor contained therein is the same. Therefore, the water vapor pressure eRH1 obtained from the relative humidity RH1 and the water vapor pressure eRH2 obtained from the relative humidity RH2 are the same. Therefore, the water vapor pressure difference ed2 when the first heater 61 is driven is obtained by the following equation.

[Mathematical Equation 4]

$$ed2 = eT2 - eT1 \times RH1/100 \quad (4)$$

For example, when the water vapor pressure difference ed2=50.6 hPa shown in the first line of FIG. 5 is a condition that can dry well without causing media damage such as cockling or breakage of the medium S, and the preset temperature T1 of the outside air is 27° C. and the preset relative humidity RH1 of the outside air is 65%, the set temperature T2 of the first heater 61 is preset to 40° C. as a predetermined temperature. The water vapor pressure difference ed2=50.6 hPa at this time becomes an index value for satisfactorily drying without causing the media damage.

As shown in the second line of FIG. 5, in a case in which the temperature of the outside air T1 is 18° C., which is lower than the preset temperature, when the set temperature T2 of the first heater 61 is driven at the predetermined temperature of 40° C., the water vapor pressure difference ed2 increases from the index value of 50.6 hPa to 60.4 hPa. When printing is performed in this state, the evaporation rate of the water contained in the droplet DR becomes too fast, so that media damage may occur in the medium S. Thus, the control unit 90 changes the set temperature T2 of the first heater 61 to a temperature lower than the predetermined temperature. As shown in the sixth line of FIG. 5, when the temperature T1=18° C., by changing the set temperature T2 of the first heater 61 from the predetermined temperature of 40° C. to 37.3° C., the water vapor pressure difference ed2 can be set to 50.4 hPa that is substantially the same as the index value.

In addition to the case in which the temperature of the outside air T1 is 18° C., when the relative humidity of the outside air RH1 is 40%, which is lower than the preset relative humidity, the control unit 90 changes the set temperature T2 of the first heater 61 to a further low temperature. As shown in the seventh line of FIG. 5, when the temperature T1 is 18° C. and the relative humidity RH1 is 40%, by changing the set temperature T2 of the first heater 61 from the predetermined temperature of 40° C. to 35.8° C., the water vapor pressure difference ed2 can be set to 50.5 hPa that is substantially the same as the index value.

As shown in the third line of FIG. 5, in a case in which the temperature T1 of the outside air is 35° C., which is higher than the preset temperature, when the set temperature T2 of the first heater 61 is driven at the predetermined temperature of 40° C., the water vapor pressure difference ed2 decreases from the index value of 50.6 hPa to 37.2 hPa. When printing is performed in this state, the evaporation rate of the water contained in the droplet DR becomes too slow, so that the ink discharged to the medium S as the droplet DR may coagulate, thus deteriorating the print quality, or the medium S may be wound on the winding unit 70 while the medium S is still undried, thus generating set-off of the ink. Thus, the control unit 90 changes the set temperature T2 of the first heater 61 to a temperature higher than the predetermined temperature. As shown in the eighth line of FIG. 5, when the temperature T1=35° C., by changing the set temperature T2 of the first heater 61 from the predetermined temperature of 40° C. to 43.2° C., the water vapor pressure difference ed2 can be set to 50.8 hPa that is substantially the same as the index value.

In addition to the case in which the temperature of the outside air T1 is 35° C., when the relative humidity of the outside air RH1 is 90%, which is higher than the preset relative humidity, the control unit 90 changes the set temperature T2 of the first heater 61 to a further high temperature. As shown in the ninth line of FIG. 5, when the temperature T1 is 35° C. and the relative humidity RH1 is 90%, by changing the set temperature T2 of the first heater 61 from the predetermined temperature of 40° C. to 46.1° C., the water vapor pressure difference ed2 can be set to 50.8 hPa that is substantially the same as the index value.

As shown in the fourth line of FIG. 5, in a case in which the relative humidity of the outside air RH1 is 40%, which is lower than the preset relative humidity, when the set temperature T2 of the first heater 61 is driven at a predetermined temperature of 40° C., the water vapor pressure difference ed2 increases from the index value of 50.6 hPa to 59.5 hPa. When printing is performed in this state, the evaporation rate of the water contained in the droplet DR becomes too fast, so that media damage may occur in the medium S. Thus, the control unit 90 changes the set temperature T2 of the first heater 61 to a temperature lower than the predetermined temperature. As shown in the tenth line of FIG. 5, when the relative humidity RH1 is 40%, by changing the set temperature T2 of the first heater 61 from the predetermined temperature of 40° C. to 37.6° C., the water vapor pressure difference ed2 can be set to 50.6 hPa that is substantially the same as the index value.

In addition to the case in which the relative humidity of the outside air RH1 is 40%, when the temperature of the outside air T1 is 18° C., which is lower than the preset temperature, the control unit 90 changes the set temperature T2 of the first heater 61 to a further low temperature. As shown in the seventh line of FIG. 5, when the relative humidity RH1 is 40% and the temperature T1 is 18° C., by changing the set temperature T2 of the first heater 61 from the predetermined temperature of 40° C. to 35.8° C., the water vapor pressure difference ed2 can be set to 50.5 hPa that is substantially the same as the index value.

As shown in the fifth line of FIG. 5, in a case in which the relative humidity of the outside air RH1 is 90%, which is higher than the preset relative humidity, when the set temperature T2 of the first heater 61 is driven at the predetermined temperature of 40° C., the water vapor pressure difference ed2 decreases from the index value of 50.6 hPa to 41.7 hPa. When printing is performed in this state, the evaporation rate of the water contained in the droplet DR becomes too fast, so that media damage may occur in the medium S. Thus, the control unit 90 changes the set temperature T2 of the first heater 61 to a temperature higher than the predetermined temperature. As shown in the eleventh line of FIG. 5, when the relative humidity RH1 is 90%, by changing the set temperature T2 of the first heater 61 from the predetermined temperature of 40° C. to 42.2° C., the water vapor pressure difference ed2 can be set to 50.8 hPa that is substantially the same as the index value.

In addition to the case in which the relative humidity of the outside air RH1 is 90%, when the temperature of the outside air T1 is 35° C., which is higher than the preset temperature, the control unit 90 changes the set temperature T2 of the first heater 61 to a further high temperature. As shown in the ninth line of FIG. 5, when the relative humidity RH1 is 90% and the temperature T1 is 35° C., by changing the set temperature T2 of the first heater 61 from the predetermined temperature of 40° C. to 46.1° C., the water vapor pressure difference ed2 can be set to 50.8 hPa that is substantially the same as the index value.

Note that the droplet discharging device 11 of the present embodiment stores, in the storage unit 92, a heater set temperature table in which various combinations of the temperature of the outside air T1 and the relative humidity of the outside air RH1 as parameters are associated with the set temperature of the heater T2 in which the water vapor pressure difference ed2 becomes the substantial index value thereof.

1-4. Printing Processing

Figure 6:
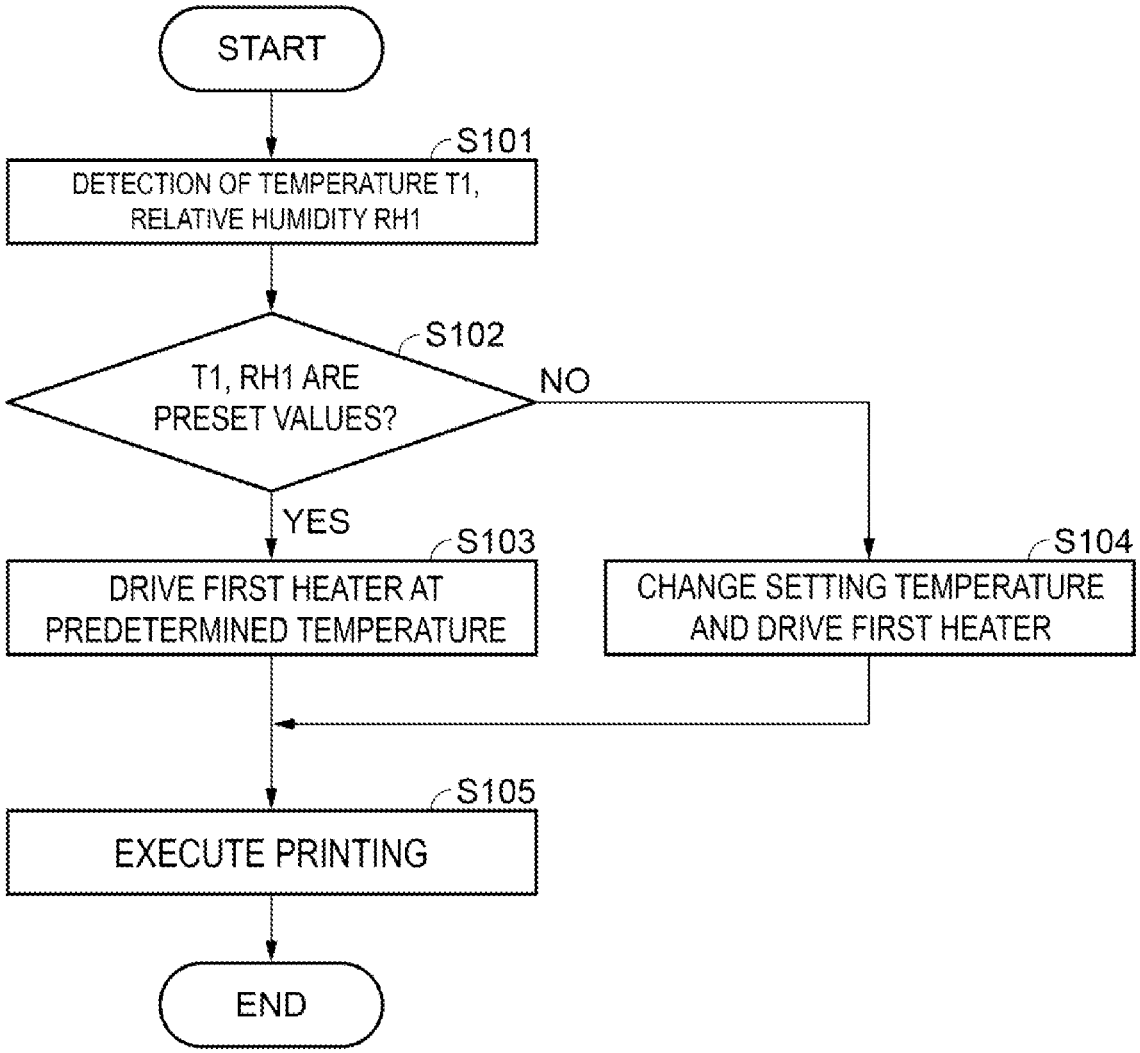
FIG. 6 is a flowchart illustrating a procedure of printing processing.

Next, printing processing will be described with reference to FIG. 6.

In step S101, when the liquid droplet discharging device 11 is turned on, the control unit 90 receives the temperature of the outside air T1 detected by the temperature sensor 83 and the relative humidity of the outside air RH1 detected by the humidity sensor 84.

In step S102, the control unit 90 determines whether or not the temperature T1 and the relative humidity RH1 are the preset values. The control unit 90 compares the temperature of the outside air T1 detected by the temperature sensor 83 with the temperature preset in the storage unit 92. Further, the control unit 90 compares the relative humidity of the outside air RH1 detected by the humidity sensor 84 with the relative humidity preset in the storage unit 92. In the present embodiment, since the air blowing fan 82 is driven when the power of the droplet discharging device 11 is turned on, the temperature of the outside air can be accurately detected by the temperature sensor 83 located in the intake flow path 81. When the control unit 90 determines that the temperature T1 and the relative humidity RH1 of the outside air are the preset values (step S102: YES), the control unit 90 shifts the processing to step S103. When the control unit 90 determines that at least one of the temperature T1 and the relative humidity RH1 is different from the preset value (step S102: NO), the control unit 90 shifts the processing to step S104.

In step S103, the control unit 90 drives the first heater 61 at the predetermined temperature. Further, the control unit 90 drives the second heater 62 at the predetermined temperature.

In step S104, the control unit 90 refers to the heater set temperature table stored in the storage unit 92, and obtains the set temperature T2 of the first heater 61 from the temperature T1 and the relative humidity RH1. Then, the control unit 90 changes the set temperature of the first heater 61 from the predetermined temperature to the set temperature T2 obtained from the heater set temperature table, and drives the first heater 61. Further, the control unit 90 changes the set temperature of the second heater 62 according to the changed set temperature T2 of the first heater 61, and drives the second heater 62.

In step S105, the control unit 90 performs printing based on the print data, and terminates this flow.

Note that in the present embodiment, the set temperature of the first heater 61 is described as being obtained from the heater set temperature table. However, the set temperature of the first heater 61 may be obtained by the control unit 90 calculating the set temperature T2 in which the water vapor pressure difference ed2 becomes the index value, from the temperature T1 and the relative humidity RH1.

Further, when the set temperature that can be set in the first heater 61 is wide, such as in increments of 5° C., the control unit 90 sets the temperature at which the water vapor pressure difference ed2 becomes closest to the index value.

Further, although the temperature sensor 83 and the humidity sensor 84 are described as being provided in the ventilation unit 80, the temperature sensor 83 and the humidity sensor 84 may be provided on, for example, the carriage 52 or the like that can directly detect the temperature and the humidity on the support unit 33.

As described above, the droplet discharging device 11 according to the present embodiment can provide the following advantages.

The droplet discharging device 11 includes the head 53 configured to discharge the droplet onto the medium S, the first heater 61 configured to heat the medium S at the position opposing to the head 53, the temperature sensor 83 configured to detect the temperature of the outside air T1 blown by the air blowing fan 82, and the control unit 90. When the temperature T1 of the outside air is lower than the preset temperature, the control unit 90 changes the set temperature of the first heater 61 to a temperature lower than the predetermined temperature. As a result, an increase in the water vapor pressure difference ed2 that serves as the driving force for evaporating water is suppressed. Thus, media damage, such as cockling, caused by the fast drying speed of the medium S can be suppressed.

When the temperature T1 of the outside air is higher than the preset temperature, the control unit 90 changes the set temperature of the first heater 61 to a temperature higher than the predetermined temperature. As a result, a decrease in the water vapor pressure difference ed2 that serves as the driving force for evaporating water is suppressed. Therefore, deterioration of print quality due to coagulation of the ink, and off-set of the ink, caused by the slow drying speed of the medium S can be suppressed.

The droplet discharging device 11 includes the humidity sensor 84 configured to detect the relative humidity of the outside air RH1. When the relative humidity RH1 of the outside air is different from the preset relative humidity, the control unit 90 further changes the set temperature of the first heater 61. Accordingly, the medium S can be suitably dried.

When the relative humidity RH1 of the outside air is lower than the preset humidity, the control unit 90 changes the set temperature of the first heater 61 to a temperature lower than the predetermined temperature. As a result, an increase in the water vapor pressure difference ed2 that serves as the driving force for evaporating water is suppressed. Thus, media damage, such as cockling, caused by the fast drying speed of the medium S can be suppressed.

When the relative humidity RH1 of the outside air is higher than the preset humidity, the control unit 90 changes the set temperature of the first heater 61 to a temperature higher than the predetermined temperature. As a result, a decrease in the water vapor pressure difference ed2 that serves as the driving force for evaporating water is suppressed. Therefore, deterioration of print quality due to coagulation of the ink, and off-set of the ink, caused by the slow drying speed of the medium S can be suppressed.

When the temperature T1 of the outside air is different from the preset temperature, the control unit 90 further changes the set temperature of the first heater 61. Accordingly, the medium S can be suitably dried.

The droplet discharging device 11 includes the second heater 62 configured to heat the medium S before the droplets are discharged thereon from the head 53. The control unit 90 changes the set temperature of the second heater 62 according to the changed set temperature T2 of the first heater 61. By preheating the medium S using the second heater 62, the temperature of the medium S located on the support unit 33 can be set to the set temperature of the first heater 61.

What is claimed is:

1. A droplet discharging device comprising:

a head including a nozzle configured to discharge a droplet onto a medium, a heater configured to heat the medium onto which the droplet is discharged from the head, the heater being disposed at a position opposing to the head and below the medium, an air blowing fan configured to blow outside air from an outside toward an inside of a housing that accommodates the head and the heater, a temperature sensor configured to detect a temperature of the outside air blown by the air blowing fan, a humidity sensor configured to detect a humidity of the outside air blown by the air blowing fan, and a control unit, wherein when the temperature of the outside air detected by the temperature sensor is lower than a preset temperature, the control unit changes a set temperature of the heater to a temperature lower than a predetermined temperature, and when the humidity of the outside air detected by the humidity sensor is different from a preset humidity, the control unit further changes a set temperature of the heater.

2. The droplet discharging device according to claim 1, wherein when the temperature of the outside air detected by the temperature sensor is higher than a preset temperature, the control unit changes a set temperature of the heater to a temperature higher than a predetermined temperature.

3. The droplet discharging device according to claim 1, comprising:

a second heater configured to heat the medium before the droplet is discharged from the head, wherein the control unit changes the set temperature of the second heater according to the changed set temperature of the heater.

4. A droplet discharging device comprising:

a head including a nozzle configured to discharge a droplet onto a medium, a heater configured to heat the medium onto which the droplet is discharged from the head, the heater being disposed at a position opposing to the head and below the medium, an air blowing fan configured to blow outside air from an outside toward an inside of a housing that accommodates the head and the heater, a humidity sensor configured to detect a relative humidity of the outside air blown by the air blowing fan, and a control unit, wherein when the relative humidity of the outside air detected by the humidity sensor is lower than a preset relative humidity, a set temperature of the heater is changed to a temperature lower than a predetermined temperature.

5. The droplet discharging device according to claim 4, wherein when the relative humidity of the outside air detected by the humidity sensor is higher than a preset humidity, a set temperature of the heater is changed to a temperature higher than a predetermined temperature.

6. The droplet discharging device according to claim 4, comprising:

a temperature sensor configured to detect a temperature of the outside air blown by the air blowing fan, wherein when the temperature of the outside air detected by the temperature sensor is different from a preset temperature, the control unit further changes the set temperature of the heater.

* * * * *